US010053809B2

(12) United States Patent
Kim et al.

(10) Patent No.: US 10,053,809 B2
(45) Date of Patent: Aug. 21, 2018

(54) WASHING MACHINE

(71) Applicant: LG ELECTRONICS INC., Seoul (KR)

(72) Inventors: Sunghoon Kim, Seoul (KR); Sanghee Yoo, Seoul (KR); Junyoung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 160 days.

(21) Appl. No.: 14/884,122

(22) Filed: Oct. 15, 2015

(65) Prior Publication Data

US 2016/0194801 A1 Jul. 7, 2016

(30) Foreign Application Priority Data

Jan. 5, 2015 (KR) ..... 10-2015-0000922

(51) Int. Cl.
*D06F 37/26* (2006.01)
*D06F 21/02* (2006.01)

(52) U.S. Cl.
CPC ..... *D06F 37/269* (2013.01); *D06F 37/262* (2013.01); *D06F 37/264* (2013.01); *D06F 21/02* (2013.01)

(58) Field of Classification Search
CPC .... D06F 37/262; D06F 37/264; D06F 37/269; D06F 37/304
USPC ..... 68/24, 58, 140, 144
See application file for complete search history.

(56) References Cited

U.S. PATENT DOCUMENTS

| | | | |
|---|---|---|---|
| 2,705,763 | A | 4/1955 | Skrobisch |
| 3,227,030 | A | 1/1966 | Preziosi et al. |
| 3,886,256 | A | 5/1975 | Ohuchi et al. |
| 4,216,663 | A | 8/1980 | Shacklock |
| 4,995,598 | A | 2/1991 | Ingham |
| 5,040,285 | A | 8/1991 | Williams et al. |
| 5,150,589 | A | 9/1992 | Williams et al. |
| 5,266,855 | A | 11/1993 | Smith et al. |

(Continued)

FOREIGN PATENT DOCUMENTS

| | | |
|---|---|---|
| AU | 199675404 B2 | 12/1996 |
| AU | 199675438 B2 | 12/1996 |

(Continued)

OTHER PUBLICATIONS

Plaintiffs Memorandum in Opposition to Motion to Stay and in Support of Cross-Motion for Preliminary Injunction filed May 18, 2009 in pending litigation against ASKO Appliance Inc. et al.

(Continued)

*Primary Examiner* — Joseph L. Perrin
(74) *Attorney, Agent, or Firm* — Dentons US LLP

(57) ABSTRACT

A tub, with a bearing housing inserted therein, and a washing machine having the same. The washing machine includes a bearing housing and a tub, the tub having a rear wall portion in which the bearing housing is inserted. The bearing housing includes a cylindrical hub having bearings, a stator mounting portion surrounding the hub, the stator mounting portion having concave portions and convex portions formed in a repetitive pattern in a circumferential direction, and an expansion portion surrounding the stator mounting portion, the expansion portion having radial ribs formed in a repetitive pattern in a circumferential direction.

19 Claims, 5 Drawing Sheets

(56) References Cited

U.S. PATENT DOCUMENTS

| | | | | |
|---|---|---|---|---|
| 5,329,791 | A | 7/1994 | Cargnel et al. | |
| 5,489,811 | A | 2/1996 | Kern et al. | |
| 5,737,944 | A | 4/1998 | Nishimura et al. | |
| 5,809,809 | A | 9/1998 | Neumann | |
| 5,862,686 | A | 1/1999 | Skrippek | |
| 6,050,113 | A | 4/2000 | Skrippek et al. | |
| 6,257,027 | B1 | 7/2001 | Imai | |
| 6,279,357 | B1 | 8/2001 | Didlick et al. | |
| 6,460,382 | B1 | 10/2002 | Kim et al. | |
| 6,474,114 | B1 | 11/2002 | Masumi Ito et al. | |
| 6,477,869 | B2 | 11/2002 | Heyder et al. | |
| 7,380,424 | B2 | 6/2008 | Kim et al. | |
| 7,418,843 | B2 | 9/2008 | Kim et al. | |
| 7,444,841 | B2 | 11/2008 | Kim et al. | |
| 7,862,871 | B2 | 1/2011 | Caudevilla et al. | |
| 2002/0194884 | A1 | 12/2002 | Heyder et al. | |
| 2004/0163428 | A1 | 8/2004 | Kim et al. | |
| 2006/0196233 | A1 | 9/2006 | Kim et al. | |
| 2007/0113597 | A1 | 5/2007 | Kim | |
| 2007/0125135 | A1 | 6/2007 | Kim et al. | |
| 2008/0148785 | A1* | 6/2008 | Lee | D06F 37/20 68/140 |
| 2009/0100879 | A1 | 4/2009 | Kim et al. | |
| 2009/0107187 | A1* | 4/2009 | Kim | D06F 37/206 68/140 |
| 2009/0113941 | A1* | 5/2009 | Kim | D06F 37/20 68/140 |
| 2009/0113942 | A1 | 5/2009 | Ha | |
| 2009/0113943 | A1 | 5/2009 | Lee | |
| 2009/0211310 | A1* | 8/2009 | Kim | D06F 37/206 68/23.1 |
| 2010/0180644 | A1* | 7/2010 | Cha | D06F 37/262 68/232 |
| 2011/0135239 | A1* | 6/2011 | Eo | B22D 17/24 384/584 |
| 2012/0011899 | A1* | 1/2012 | Kwon | D06F 25/00 68/140 |
| 2013/0074553 | A1* | 3/2013 | Cha | D06F 37/206 68/140 |
| 2014/0069150 | A1* | 3/2014 | Bang | D06F 37/206 68/140 |
| 2014/0069151 | A1* | 3/2014 | Yoon | D06F 37/206 68/140 |
| 2014/0102151 | A1* | 4/2014 | Yoon | H02K 1/2773 68/140 |

FOREIGN PATENT DOCUMENTS

| | | | |
|---|---|---|---|
| CN | 1274782 | A | 11/2000 |
| CN | 1293276 | A | 5/2001 |
| CN | 1293277 | A | 5/2001 |
| DE | 43 35 966 | A1 | 4/1995 |
| DE | 198 59 568 | A1 | 6/2000 |
| EP | 0 219 115 | A2 | 4/1987 |
| EP | 0 361 775 | A2 | 4/1990 |
| EP | 0 620 308 | A2 | 10/1994 |
| EP | 1 079 014 | A1 | 2/2001 |
| EP | 1 094 144 | A2 | 4/2001 |
| EP | 1 094 145 | A2 | 4/2001 |
| EP | 1 116 812 | A1 | 7/2001 |
| EP | 1 428 924 | A1 | 6/2004 |
| EP | 1 707 661 | A2 | 10/2006 |
| GB | 2 030 896 | A | 4/1980 |
| GB | 2 332 212 | A | 6/1999 |
| GB | 2 333 300 | A | 7/1999 |
| JP | 58-207834 | A | 12/1983 |
| JP | 9-182368 | A | 7/1997 |
| JP | 2000-42287 | A | 2/2000 |
| JP | 2000-116037 | A | 4/2000 |
| JP | 2000-325693 | A | 11/2000 |
| KR | 20-1992-0012151 | U | 7/1992 |
| KR | 1997-0051370 | B1 | 10/1997 |
| KR | 20-1998-0058943 | U | 10/1998 |
| KR | 1999-0030909 | A | 5/1999 |
| KR | 1999-0081170 | A | 11/1999 |
| KR | 10-2001-0088215 | A | 9/2001 |
| WO | 01/44556 | A1 | 6/2001 |
| WO | 02/084842 | A1 | 10/2002 |

OTHER PUBLICATIONS

Complaints in pending litigation against ASKO Appliance Inc., et al. filed on Nov. 5, 2008.

Defendants' Reply in Further Support of Defendants' Reply in pending litigation against ASKO Appliance Inc., et al. filed on May 29, 2009.

Declaration in Support of Defendants' Reply in pending litigation against ASKO Appliance Inc., et al. filed on May 29, 2009 (including Exhibits 1-7).

Order Denying Defendants' Motion for Stay and Dismissing Plaintiffs Motion for Preliminary Injunction in pending litigation against ASKO Appliance Inc., et al. filed on Jun. 17, 2009.

Original Request for Reexamination of Corresponding U.S. Pat. No. 7,418,843 filed on Dec. 15, 2008.

Decision Granting Request for Reexamination of Corresponding U.S. Pat. No. 7,418,843 dated Jan. 23, 2009.

Original Request for Reexamination for Corresponding U.S. Pat. No. 7,380,424 filed on Nov. 14, 2008.

Corrected Request for Reexamination of Corresponding U.S. Pat. No. 7,380,424 filed on Jan. 28, 2009.

Decision Granting Request for Reexamination of Corresponding U.S. Pat. No. 7,380,424 dated Feb. 26, 2009.

* cited by examiner (PRIOR ART)

(PRIOR ART)

(PRIOR ART)

WASHING MACHINE

This application claims the benefit of Korean Patent Application No. 10-2015-0000922, filed on Jan. 5, 2015, which is hereby incorporated by reference as if fully set forth herein.

BACKGROUND

Field

The present disclosure relates to a washing machine, and more particularly to a tub, which is made by injection molding with a bearing housing inserted therein, and a washing machine having the same.

Discussion of the Related Art

In general, washing machines are apparatuses which perform washing, rinsing, and dehydration operations by rotating a drum or a pulsator using the driving force of a motor. Wash water is accommodated in a tub, and the drum is rotatably provided in the tub.

According to the operation methods of washing machines, the washing machines may be classified into an indirect-connection type washing machine, in which the driving force of a motor is transferred to a drum using a pulley or the like, and a direct-connection type washing machine in which the driving force of a motor mounted to a tub is directly transferred to a drum. In recent years, the direct-connection type washing machine has been increasingly utilized.

The structure of a direct-connection type drum washing machine will be briefly described with reference to FIG. 1.

A tub 2 is provided in a cabinet 1, and a drum 3 is rotatably provided in tub 2. A motor, which consists of a stator 6 and a rotor 5, is mounted to the rear wall portion of tub 2.

Rotor 5 surrounds stator 6, and is connected to a shaft 4. Shaft 4 is coupled to drum 3 through the rear wall portion of tub 2. Accordingly, the rotation of rotor 5 is directly transferred to drum 3 via shaft 4.

The rear wall portion of tub 2 is provided with a bearing housing for rotatably supporting shaft 4. The bearing housing may be mounted to tub 2, or may be integrally formed with tub 2 by insert-injection molding.

FIGS. 2 and 3 illustrate an example of a conventional tub 20 made by injection molding with a bearing housing 30 inserted therein. FIG. 2 illustrates an outer surface of a rear wall portion 21 of tub 20, and FIG. 3 illustrates an inner surface of the rear wall portion 21 of tub 20. A washing machine having such a tub is disclosed in PCT International Application No. PCT/KR2006/001622 (PCT International Publication No. WO2007/126167), which is a related patent.

The entire bearing housing 30 is substantially inserted in rear wall portion 21 of the tub, except for a central hub 31 thereof. That is, bearing housing 30 is not exposed to the outside, but is surrounded by tub. A shaft passes through the center of hub 31, and bearings are provided inside the hub.

Bearing housing 30 is arranged radially inward on the basis of line "A" shown in FIGS. 2 and 3. Accordingly, the inside of line "A" may be called an insert portion 22 in which the bearing housing is inserted in the tub. On the other hand, the outside of line "A" may be called a non-insert portion 23 in which the bearing housing is not inserted in the tub.

Bearing housing 30 includes a stator mounting portion in which concave portions 32 and convex portions 33 are formed in a repetitive pattern in a circumferential direction from the outside of hub 31 in the radial direction thereof. Accordingly, hub 31 and the stator mounting portion are integrally formed and inserted in the tub. FIG. 2 illustrates the state in which a bearing housing 30 having six concave portions 32 and six convex portions 33 is inserted in tub 20. Here, the stator mounting portion may correspond to the outer surface of rear wall portion 21 of the tub.

The non-insert portion 23 of tub 20 is formed to have the same pattern as insert portion 22. That is, concave portions 24 and convex portions 25 of the tub are formed similarly to concave portions 32 and convex portions 33 of bearing housing 30. Concave portions 24 and convex portions 25 are reversely shown as convex portions 24' and concave portions 25' on the inner surface of rear wall portion 21. That is, convex portions 24' on the inner surface of the rear wall portion of the tub are shown as concave portions 24 on the outer surface of the rear wall portion. The same is true for respective convex/concave portions 25 and 25'.

The inner surface of rear wall portion 21 of the tub has a shape and a pattern which are identical or similar to those of the outer surface of rear wall portion 21 of the tub.

Accordingly, in rear wall portion 21 of the tub, concave portions 24 and 25' and convex portions 25 and 24' are formed in a repetitive pattern in the circumferential direction from the outside of hub 31 in the radial direction thereof. This pattern extends to the edge of rear wall portion 21 of the tub. In other words, the shape and pattern of the bearing housing, which is arranged inward from line "A", are identically formed throughout rear wall portion 21 of the tub.

However, the tub has the following problems.

First, noise may increase due to concave portions 24 and 25' and convex portions 25 and 24' of rear wall portion 21 of the tub. Wash water accommodated in the tub is tumbled according to the rotation of the drum. Concave portions 24 and 25' and convex portions 25 and 24' act as obstacles to the tumbling of wash water. Particularly, concave portions 25' on the inner surface of rear wall portion 21 of the tub act as resistance to wash water, thereby causing noise when the drum rotates.

Secondly, bearing housing 30 may protrude through rear wall portion 21 of the tub at line "A", i.e. at the boundary between insert portion 22 and non-insert portion 23. For this reason, the position of the bearing housing is dislocated due to vibration, thereby entailing the risk of damage to the tub. In other words, the bearing housing may be inadequately coupled to the tub.

Thirdly, because insert portion 22 and non-insert portion 23 have the same pattern, the thickness of the tub may be increased. Particularly, the thickness of the tub may be unnecessarily increased at the edge of rear wall portion 21 of tub 20. For this reason, the weight of the tub and material costs are increased.

The exterior size of a conventional washing machine, i.e. the horizontal width of a cabinet, is mainly 24 or 27 inches. Due to this external size, the drum and the tub may have only a limited size, and thus the washing machine may have only a limited washing capacity of about 15 kg.

However, in recent years, the exterior size of the washing machine has enlarged to 29 or 30 inches, and thus the washing machine is enlarged to have a washing capacity of about 20 kg. Accordingly, the sizes of the drum and the tub, especially the diameters thereof are necessarily increased. Of course, the motor for driving the drum has an increased size, and the required torque of the motor is also increased.

For this reason, there is a need to improve the structure and the size of the conventional bearing housing in order to more securely fix the motor.

SUMMARY

Accordingly, the present disclosure is directed to a washing machine that substantially obviates one or more problems due to limitations and disadvantages of the related art.

An object is to provide a washing machine in which a bearing housing is more securely inserted in and coupled to a tub.

Another object is to provide a washing machine capable of preventing damage from occurring at the boundary between an insert portion and a non-insert portion of a tub.

Another object is to provide a washing machine capable of reducing material costs by decreasing the thickness of a tub.

Another object is to provide a washing machine capable of reducing noise.

A further object is to provide a washing machine in which a bearing housing can be reliably coupled to a tub even though the tub has an increased diameter.

Additional advantages, objects, and features will be set forth in part in the description which follows and in part will become apparent to those having ordinary skill in the art upon examination of the following or may be learned from practice of embodiments of the invention. The objectives and other advantages may be realized and attained by the structure particularly pointed out in the written description and claims hereof as well as the appended drawings.

To achieve these objects and other advantages and in accordance with the purpose of the disclosure, as embodied and broadly described herein, there is provided a washing machine including a bearing housing and a tub, and the tub having a rear wall portion in which the bearing housing is inserted. The bearing housing includes a cylindrical hub having bearings, a stator mounting portion surrounding the hub, the stator mounting portion having concave portions and convex portions formed in a repetitive pattern in a circumferential direction, and an expansion portion surrounding the stator mounting portion, the expansion portion having radial ribs formed in a repetitive pattern in a circumferential direction.

Thus, the stator mounting portion close to the center of a shaft for driving a drum preferably has a shape and a pattern which are different from those of the expansion portion far from the center of the shaft.

The bearing housing may be made by aluminum die casting, and be integrally formed to have a single body. Thus, the entire bearing housing is substantially embedded in the rear wall portion of the tub.

The bearing housing may include a first circumferential rib which divides the stator mounting portion and the expansion portion in a radial direction. Thus, the shape and pattern of the bearing housing, which is arranged radially inward from the first circumferential rib, differ from those of the bearing housing which is arranged radially outward from the first circumferential rib. Since the first circumferential rib has a vertical width or a height, the first circumferential rib has an outer peripheral surface of a certain area. Therefore, the first circumferential rib can prevent the shape and pattern of the bearing housing from rapidly varying between the inside and outside of the first circumferential rib in the radial direction thereof.

A flat surface may be formed between one radial rib and another radial rib in the expansion portion. That is, the flat surface is preferably formed between adjacent radial ribs. The flat surface may be formed with a through-portion, through which an injection-molded product passes when the tub is made by injection molding. The radial ribs may not be formed in the stator mounting portion.

The bearing housing may include a second circumferential rib formed at a radial distal end of the expansion portion.

The second circumferential rib may divide the rear wall portion into an insert portion, in which the bearing housing is inserted, and a non-insert portion in which the bearing housing is not inserted. That is, the insert portion may be located radially inward from the second circumferential rib, and the non-insert portion may be located radially outward from the second circumferential rib.

The second circumferential rib also has a vertical width or a height. Thus, a coupling surface between the bearing housing and the tub may be formed through the circumferential surface of the second circumferential rib. Therefore, strength can be sufficiently provided at the boundary between the insert portion and the non-insert portion.

The bearing housing may include a third circumferential rib arranged between the first and second circumferential ribs. The third circumferential rib can prevent strength from deteriorating due to an increase in length of each radial rib.

The non-insert portion may include radial ribs and a circumferential rib of the tub so as to have the same pattern as the expansion portion. The radial ribs and the circumferential rib of the tub can further increase coupling force at the boundary between the insert portion and the non-insert portion. This is because the radial ribs of the tub corresponding to the second circumferential rib are integrally connected to the radial ribs and the circumferential rib of the non-insert portion.

The radial ribs of the tub may be radially formed on the same lines as the radial ribs of the bearing housing. The circumferential rib of the tub may have the same center as the circumferential ribs of the bearing housing.

Through the arrangement of the same lines and the same center, the strength of the ribs can be further reinforced. Particularly, the strength and the coupling force can be further increased at the boundary between the stator mounting portion and the expansion portion and at the boundary between the insert portion and the non-insert portion.

A radial distance between the first circumferential rib and the third circumferential rib may be greater than a radial distance between the third circumferential rib and the second circumferential rib. This structure facilitates an increase in strength at the portion in which the bearing housing is expected to be significantly displaced relative to the tub (i.e., at the boundary between the insert portion having the largest radius and the non-insert portion).

For example, if the bearing housing inserted in the tub is twisted relative to the tub by an angle of 1 degree, the circumferential distance corresponding to the angle of 1 degree is further increased as the bearing housing is directed in the radial direction. Thus, the third circumferential rib is preferably provided so as to be close to the second circumferential rib rather than the first circumferential rib. Through this structure, the coupling area between the tub and the bearing housing can be further increased. In other words, the coupling area between the tub and the bearing housing in the space between the second circumferential rib and the third circumferential rib may be greater than the coupling area between the tub and the bearing housing in the space between the first circumferential rib and the third circumferential rib.

The rear wall portion of the tub may be formed to have the same pattern as the stator mounting portion and the expansion portion of the bearing housing so as to correspond thereto. That is, it is preferable that the rear wall portion of the tub have a shape that substantially reflects that of the bearing housing as it is.

The rear wall portion of the tub may be vertically arranged. By a difference in shape of the stator mounting portion and the expansion portion in the drum washing machine in which the tub is vertically arranged, noise can be significantly reduced.

A ratio of an expansion portion radius measured from a center of the hub to a distal end of the expansion portion to a mounting portion radius measured from the center of the hub to a distal end of the stator mounting portion may be less than 2. Preferably, the ratio of the expansion portion radius to the mounting portion radius may be equal to or greater than 5/3.

Increasing the radius of the stator mounting portion is not preferable due to an increase of noise and an increase in thickness of the tub. That is, it is preferable that the stator mounting portion substantially have a radius corresponding to that of a stator mounted thereto.

Additionally, the radius of the bearing housing is preferably increased through an increase in radius of the expansion portion. Thereby, it is possible to reduce noise and decrease the thickness of the tub.

In another aspect of the present invention, there is provided a drum washing machine including a bearing housing and a tub, the tub having a rear wall portion in which the bearing housing is inserted, the tub having a drum rotating about a horizontal axis.

Specifically, the bearing housing include a cylindrical hub having bearings, a stator mounting portion surrounding the hub, the stator mounting portion having concave portions and convex portions formed in a repetitive pattern in a circumferential direction, an expansion portion surrounding the stator mounting portion, the expansion portion having radial ribs formed in a repetitive pattern in a circumferential direction, and a first circumferential rib dividing the stator mounting portion and the expansion portion in a radial direction, inner and outer surfaces of the rear wall portion of the tub have the same shape as that of the bearing housing since the bearing housing is inserted in the rear wall portion, and a ratio of an expansion portion radius measured from a center of the hub to a distal end of the expansion portion to a mounting portion radius measured from the center of the hub to a distal end of the stator mounting portion is less than 2.

The distal end of the stator mounting portion may be located above a maximum allowable level of water in the tub when washing is performed in the drum washing machine.

The concave portions may be concave toward the rear of the tub, the convex portions may be convex toward the front of the tub, and the concave portions and the convex portions may not be repetitively formed in the expansion portion.

Thus, it is possible to prevent the wash water from interfering with the concave portions and the convex portions of the stator mounting portion even though the level of water in the tub is varied. In other words, it is possible to prevent the wash water tumbled in the circumferential direction from being tumbled in the forward and backward directions, which is caused by striking the concave portions and the convex portions of the stator mounting portion. That is, it is possible to reduce noise caused by striking between the wash water and the inner surface of the rear wall of the tub in the drum washing machine in which the drum substantially rotates about the horizontal axis.

Each intersection point between the radial ribs and the first circumferential rib may have a circular or oval cross-section. That is, the cross-section of the intersection point is preferably greater than the sum of the cross-sections of the respective radial ribs and first circumferential rib.

Thus, the strength of the intersection point itself can be reinforced, and the coupling area between the intersection point and the tub can be further increased by the intersection point.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
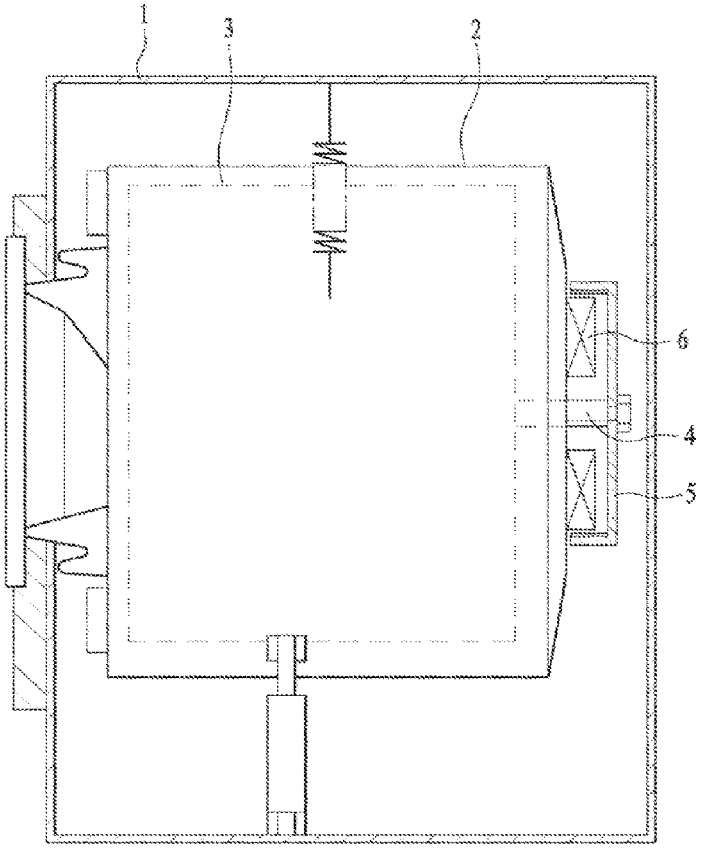
FIG. 1 is a cross-sectional view schematically illustrating a direct-connection type washing machine according to the related art.

Reference will now be made in detail to the preferred embodiments of the present invention, examples of which are illustrated in the accompanying drawings. Wherever possible, the same reference numbers will be used throughout the drawings to refer to the same or like parts.

First, a bearing housing 300 of a washing machine according to an embodiment of the present invention will be described in detail with reference to FIG. 4.

Bearing housing 300 may include a cylindrical hub 310 having bearings. Bearing housing 300 may include a stator mounting portion 320 which surrounds hub 310 at the outside of hub 310 in the radial direction thereof. Stator mounting portion 320 preferably has concave portions 326 and convex portions 325 which are formed in a repetitive pattern in a circumferential direction.

As in the related art, the entire bearing housing 300, except for hub 310, may be substantially inserted in the tub.

Hub 310 and stator mounting portion 320 of bearing housing 300 may have a shape which is identical or similar to those of the conventional bearing housing. However, it is preferable that bearing housing 300 according to the embodiment further include an expansion portion 330 which surrounds stator mounting portion 320 at the outside of stator mounting portion 320 in the radial direction thereof. Expansion portion 330 preferably has radial ribs 370 which are formed in a repetitive pattern in a circumferential direction. Accordingly, stator mounting portion 320 preferably has a shape and a pattern different from expansion portion 330.

Figure 2:
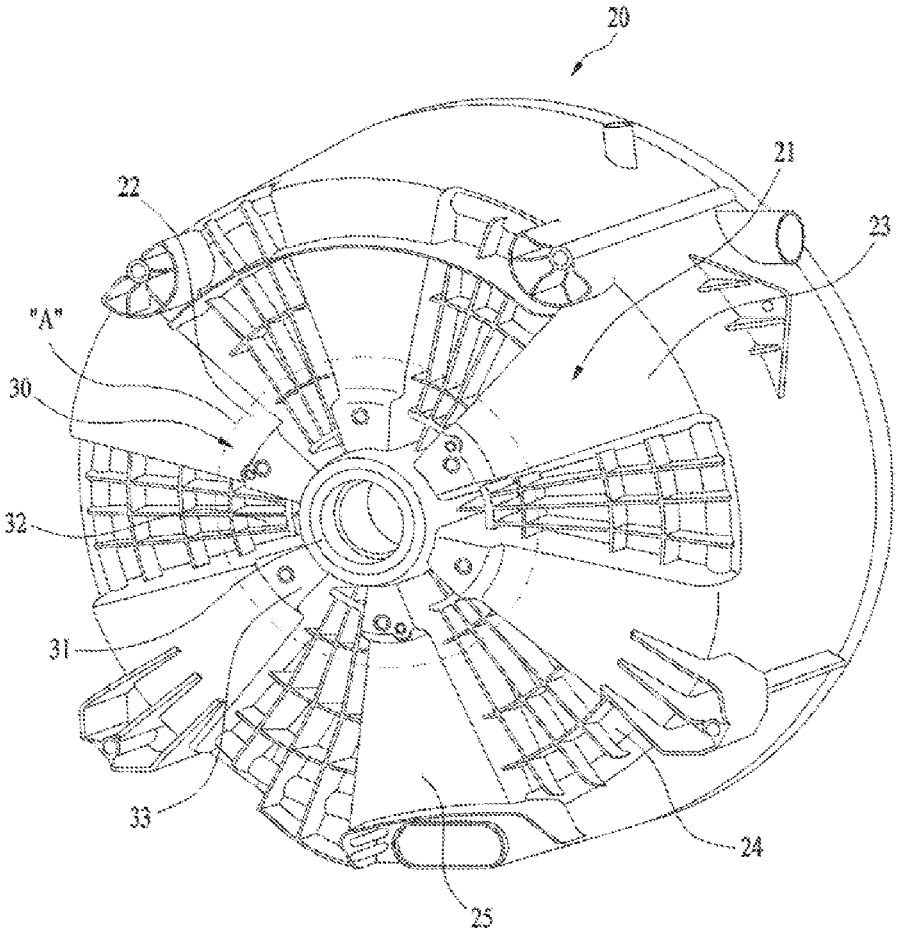
FIG. 2 is a perspective view illustrating the outer surface of the rear wall portion of a tub in the conventional washing machine.
Figure 3:
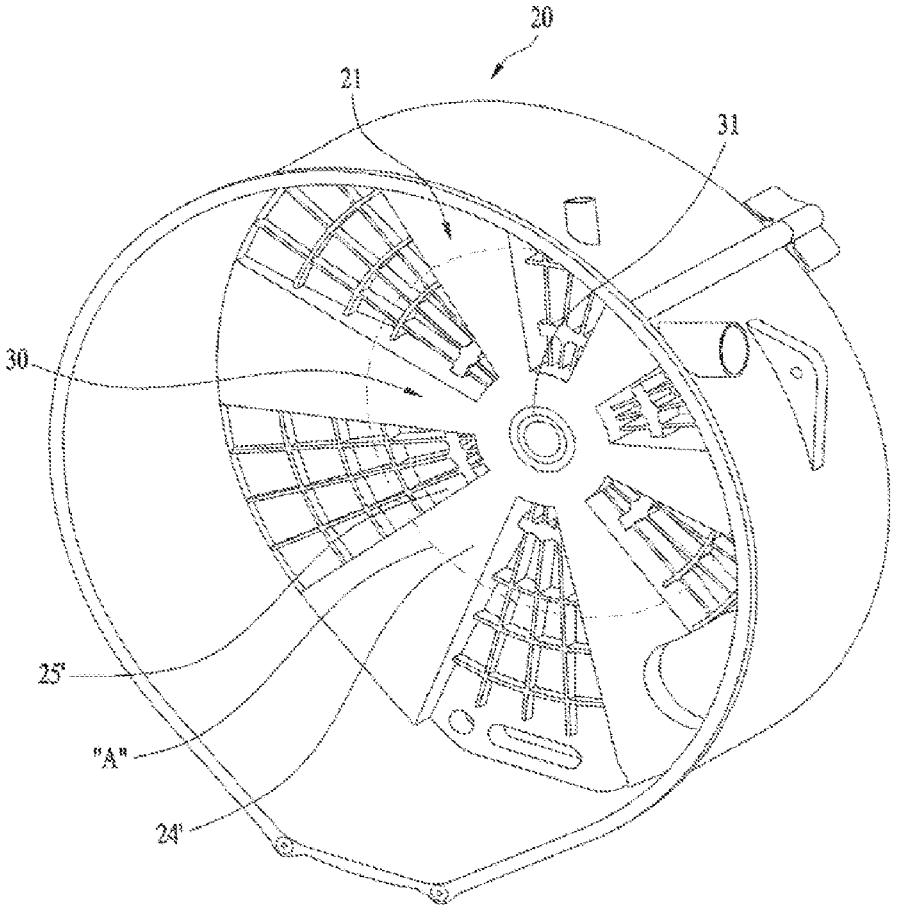
FIG. 3 is a perspective view illustrating the inner surface of the rear wall portion of the tub in the conventional washing machine.

In general, the bearing housing must have an increased diameter as the size of the tub is increased. Therefore, the bearing housing inserted in the tub can have an increased diameter by increasing the diameter of line "A" shown in FIGS. 2 and 3.

However, in this case, the thickness of the tub is further increased in proportion to the increased diameter of the bearing housing in the expansion portion thereof. This is because the expansion portion of the bearing housing also has to be inserted in the rear wall portion of the tub.

Moreover, noise may be further increased due to the repetitive pattern of the concave and convex portions. Such noise may be further increased in a drum washing machine to which a tub is vertically mounted. The reason is because the rear wall portion of the tub is substantially vertically located and a large quantity of wash water is collected in the expansion portion.

In view of this problem, the present inventors effectively realized a stator mounting portion having a shape and a pattern different from those of an expansion portion.

That is, it is more effective for stator mounting portion 320 to have concave portions 326 and convex portions 325 formed in a repetitive pattern in the circumferential direction, and for expansion portion 330 to have radial ribs 370 formed in a repetitive pattern in the circumferential direction. It is more effective for the concave portions and the convex portions not to be formed in a repetitive pattern in the circumferential direction in expansion portion 330.

This means that coupling surfaces, at which stator mounting portion 320 and expansion portion 330 are inserted in and coupled to the tub, differ from each other. That is, the coupling surfaces have different directions and patterns. Thus, it is possible to effectively deal with both circumferential vibration and radial vibration.

A first circumferential rib 340 is preferably formed between stator mounting portion 320 and expansion portion 330. That is, first circumferential rib 340 is preferably formed to divide stator mounting portion 320 and expansion portion 330. First circumferential rib 340 has a radial support surface which is formed at the boundary between the stator mounting portion and the expansion portion. Thus, bearing housing 300 may be more securely coupled to the tub.

Meanwhile, flat surfaces 380 are preferably formed between respective radial ribs 370. That is, each of the flat surfaces 380 is preferably formed between two adjacent radial ribs. Flat surfaces 380 may have a linear or curved cross-section. Flat surface 380 is preferably formed with a through-portion 385, through which an injection-molded product passes when the tub is made by injection molding.

The injection-molded product may be uniformly supplied to the front and rear of bearing housing 300 through the through-portion 385. Additionally, a coupling area between bearing housing 300 and the tub may be further increased through the through-portion 385.

A second circumferential rib 350 is preferably formed at the radial distal end of the expansion portion. Second circumferential rib 350 preferably divides the rear wall portion of the tub into an insert portion and a non-insert portion. That is, the bearing housing is arranged radially inward from second circumferential rib 350, but it is not arranged radially outward from second circumferential rib 350.

As described above, expansion portion 330 further extends in the radial direction from stator mounting portion 320. Thus, the diameter of the bearing housing according to one embodiment may be further increased compared to when the conventional bearing housing is used for a washing machine having a size of 24 or 27 inches. That is, as the tub has an increased diameter in order to be used for a washing machine having a size of 29 or 30 inches, the diameter of the bearing housing may be increased through the expansion portion.

Here, second circumferential rib 350 has a vertical width, i.e. a predetermined height. Thus, a circumferential coupling surface is formed between the insert portion and the non-insert portion. This means that the coupling area at the boundary between the insert portion and the non-insert portion is further increased. Therefore, the bearing housing can be prevented from protruding through the tub at the boundary between the insert portion and the non-insert portion.

Meanwhile, a third circumferential rib 360 may be formed between the first and second circumferential ribs 340 and 350. That is, third circumferential rib 360 may be formed in order to prevent the expansion portion from having poor strength due to the excessively long length of each radial rib of the expansion portion.

Meanwhile, the radial distance between first circumferential rib 340 and third circumferential rib 360 in the bearing housing is preferably greater than that between third circumferential rib 360 and second circumferential rib 350.

The ratio of a radius d2 (an expansion portion radius) from the center of hub 310 to the distal end of the expansion portion to a radius d1 (a mounting portion radius) from the center of hub 310 to the distal end of stator mounting portion 320 is preferably less than 2.

The ratio (d2/d1) of the expansion portion radius d2 to the mounting portion radius d1 is preferably equal to or greater than 5/3. The radiuses d1 and d2 may refer to the radius of first circumferential rib 340 and the radius of second circumferential rib 350.

The radius d1 may depend on the size of a stator mounted to the mounting portion. Accordingly, the radius d1 has a limited size. In addition, if the size of the radius d1 is increased, the above problems are caused. Thus, the ratio is preferably between 5/3 and 2 in consideration of noise, stator mounting, tub thickness, and the like.

Figure 4:
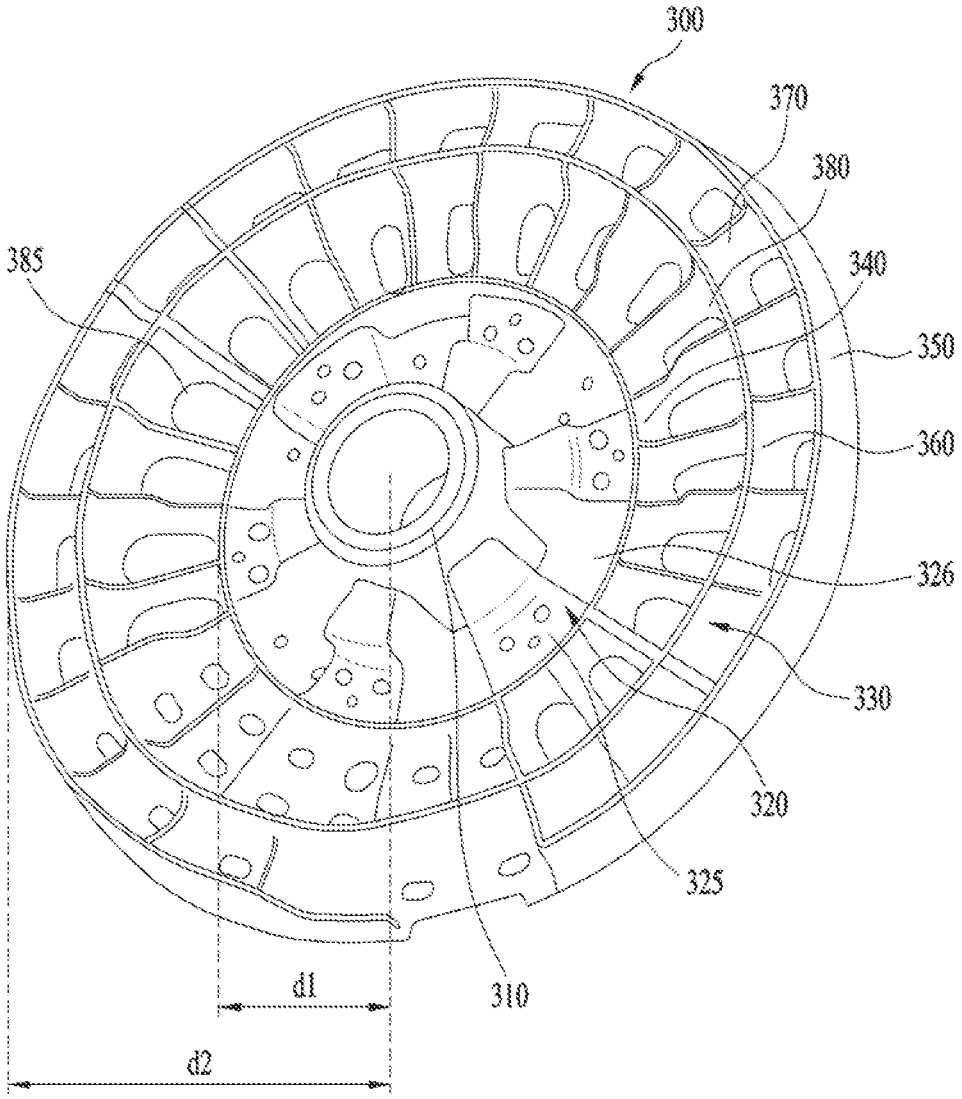
FIG. 4 is a perspective view illustrating a bearing housing according to an embodiment of the present invention.
Figure 5:
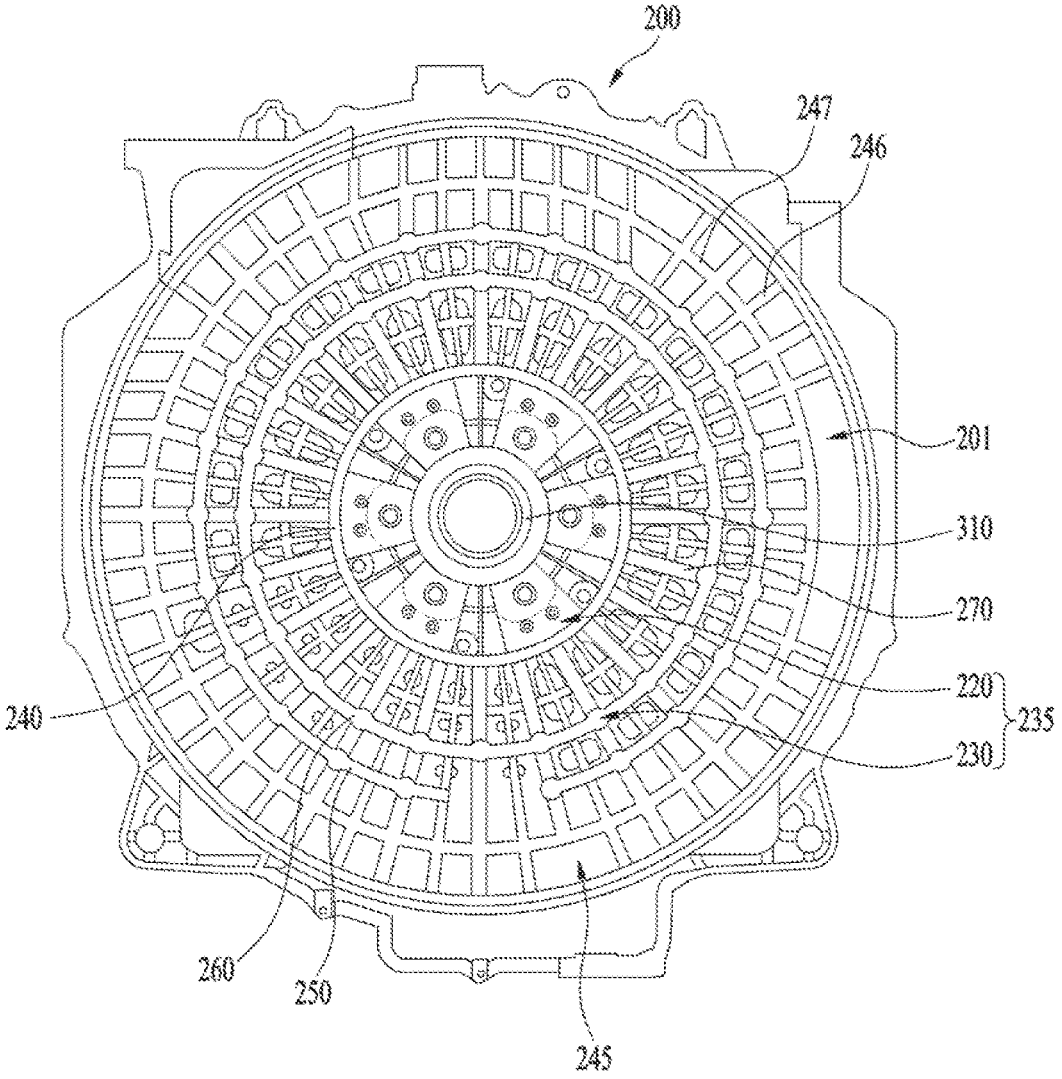
FIG. 5 is a front view illustrating a rear wall portion of a tub made by injection molding with the bearing housing illustrated in FIG. 4 inserted therein.

FIG. 5 is a front view illustrating rear wall portion 201 of tub 200 in which bearing housing 300 illustrated in FIG. 4 is inserted.

As illustrated in the drawing, the entire bearing housing 300, except for hub 310, is substantially inserted in tub 200.

It is preferable that rear wall portion 201 of tub 200 have a shape that substantially reflects that of bearing housing 300 as it is. That is, rear wall portion 201 in insert portion 235, in which bearing housing 300 is inserted, preferably has the same shape and pattern as those of bearing housing 300.

The first, second, and third circumferential ribs 340, 350, and 360 of the bearing housing correspond to first, second, and third circumferential ribs 240, 250, and 260 of the tub.

Mounting portion 320 and expansion portion 330 of the bearing housing correspond to a mounting portion 220 and an expansion portion 230 of the tub. Mounting portion 220 and expansion portion 230 form insert portion 235. Radial ribs 370 of the bearing housing correspond to radial ribs 270 of the tub.

Accordingly, insert portion 235 has convex portions and concave portions which are repetitively formed in a circumferential direction so as to correspond to stator mounting portion 320. The radial ribs are repetitively formed in a circumferential direction so as to correspond to expansion portion 330.

That is, the shape and pattern of bearing housing 300 are preferably reflected, as they are, in insert portion 235. This means that the ribs of bearing housing 300 and the ribs of insert portion 235 have the same line or center. Additionally, since a coupling surface is formed between the ribs of bearing housing 300 and the ribs of insert portion 235, the coupling force therebetween is increased.

Furthermore, non-insert portion 245, which is arranged radially outward from insert portion 235, preferably has ribs which are formed to have the same pattern as the ribs formed in insert portion 235.

For example, non-insert portion 245 preferably has radial ribs 246 and a circumferential rib 247. Radial ribs 246 and circumferential rib 247 do not form a coupling surface with bearing housing 300. However, radial ribs 246 are preferably located on the same line as radial ribs 370 of bearing housing 300. Circumferential rib 247 preferable has the same center as the circumferential ribs of bearing housing 300.

Ribs 246 and 247, which are formed in non-insert portion 245, increase the strength of rear wall portion 201 of the tub itself. Particularly, the ribs further increase the strength at the boundary between insert portion 235 and non-insert portion 245. The reason is because radial ribs 246 are located on the same lines as radial ribs 370 of bearing housing 300.

In accordance with the present disclosure, it is possible to provide a washing machine in which a bearing housing is more securely inserted in and coupled to a tub.

In addition, the washing machine can prevent damage from occurring at the boundary between an insert portion and a non-insert portion of the tub.

In addition, the washing machine can reduce material costs by decreasing the thickness of the tub.

In addition, the washing machine can reduce noise.

In addition, in the washing machine, the bearing housing can be reliably coupled to the tub even when the tub has an increased diameter.

It will be apparent to those skilled in the art that various modifications and variations can be made in the present invention without departing from the spirit or scope of the invention.

What is claimed is:

1. A washing machine including a bearing housing and a tub, the tub having one side in which the bearing housing is inserted, the bearing housing comprising:

a cylindrical hub having bearings;

a stator mounting portion provided on an outer peripheral surface of the hub, the stator mounting portion having concave portions and convex portions formed in a repetitive pattern in a circumferential direction; and an expansion portion provided on an outer peripheral surface of the stator mounting portion, the expansion portion having radial ribs formed in a repetitive pattern in a circumferential direction, wherein the one side of the tub comprises:

an insert portion provided at the center of the one side of the tub into which the bearing housing is inserted; and a non-insert portion provided on an outer peripheral surface of the insert portion, wherein each of the concave portions and convex portions of the stator mounting portion is configured to support a certain area of the outer peripheral surface of the hub, wherein the insert portion is formed to have the same pattern as the stator mounting portion and the expansion portion of the bearing housing so as to correspond thereto, and wherein the non-insertion portion comprises other radial ribs extending from the radial ribs of the expansion portion to prevent vortices from being generated on one side of the tub.

2. The washing machine of claim 1, wherein the bearing housing is made by aluminum die casting and is integrally formed to have a single body.

3. The washing machine of claim 1, wherein the bearing housing comprises a first circumferential rib which divides the stator mounting portion and the expansion portion in a radial direction.

4. The washing machine of claim 3, wherein a flat surface is formed between one radial rib and another radial rib in the expansion portion.

5. The washing machine of claim 4, wherein the flat surface is formed with a through-portion, through which an injection-molded product passes when the tub is made by injection molding.

6. The washing machine of claim 3, wherein the bearing housing comprises a second circumferential rib formed at a radial distal end of the expansion portion.

7. The washing machine of claim 6, wherein the second circumferential rib divides the one side portion of the tub into an insert portion, in which the bearing housing is inserted, and a non-insert portion, in which the bearing housing is not inserted.

8. The washing machine of claim 7, wherein the bearing housing comprises a third circumferential rib arranged between the first and second circumferential ribs.

9. The washing machine of claim 7, wherein the non-insert portion comprises radial ribs and a circumferential rib of the tub so as to have the same pattern as the expansion portion.

10. The washing machine of claim 9, wherein the radial ribs of the tub are radially formed on the same lines as the radial ribs of the bearing housing.

11. The washing machine of claim 9, wherein the circumferential rib of the tub has the same center as the circumferential ribs of the bearing housing.

12. The washing machine of claim 8, wherein a radial distance between the first circumferential rib and the third circumferential rib is greater than a radial distance between the third circumferential rib and the second circumferential rib.

13. The washing machine of claim 1, wherein the one side portion of the tub is vertically arranged.

14. The washing machine of claim 1, wherein a ratio of an expansion portion radius measured from a center of the hub to a distal end of the expansion portion to a mounting portion radius measured from the center of the hub to a distal end of the stator mounting portion is less than 2.

15. The washing machine of claim 14, wherein the ratio of the expansion portion radius to the mounting portion radius is equal to or greater than 5/3.

16. A drum washing machine including a bearing housing and a tub, and the tub having one side in which the bearing housing is inserted, the tub having a drum rotating about a horizontal axis, wherein the bearing housing comprises:

a cylindrical hub having bearings;

a stator mounting portion provided on an outer peripheral surface of the hub, the stator mounting portion having concave portions and convex portions formed in a repetitive pattern in a circumferential direction;

an expansion portion provided on an outer peripheral surface of the stator mounting portion, the expansion portion having radial ribs formed in a repetitive pattern in a circumferential direction;

a first circumferential rib dividing the stator mounting portion and the expansion portion in a radial direction;

a second circumferential rib formed at a radial distal end of the expansion portion; and a third circumferential rib arranged between the first and second circumferential ribs;

wherein the one side of the tub comprising:

an insert portion provided at the center of the one side of the tub into which the bearing housing is inserted; and a non-insert portion provided on an outer peripheral surface of the insert portion, wherein each of the concave portions and convex portions of the stator mounting portion configure to support a certain area of the outer peripheral surface of the hub, wherein the insert portion is formed to have the same pattern as the stator mounting portion and the expansion portion of the bearing housing so as to correspond thereto, and wherein the non-insertion portion comprises other radial ribs extending from the radial ribs of the expansion portion to prevent vortices from being generated on one side of the tub.

17. The drum washing machine of claim 16, wherein a radial distance between the first circumferential rib and the third circumferential rib is greater than a radial distance between the third circumferential rib and the second circumferential rib.

18. The drum washing machine of claim 17, wherein a ratio of an expansion portion radius measured from a center of the hub to a distal end of the expansion portion to a mounting portion radius measured from the center of the hub to a distal end of the stator mounting portion is less than 2, wherein the distal end of the stator mounting portion is located above a maximum allowable level of water in the tub when washing is performed in the drum washing machine, and wherein the concave portions are concave toward the rear of the tub, the convex portions are convex toward the front of the tub, and the concave portions and the convex portions are not repetitively formed in the expansion portion.

19. The drum washing machine of claim 16, wherein each intersection point between the radial ribs and the first circumferential rib has a circular or oval cross-section.

* * * * *